US009421561B2

(12) United States Patent
Yaita et al.

(10) Patent No.: US 9,421,561 B2
(45) Date of Patent: Aug. 23, 2016

(54) WATER SPOUTING DEVICE

(71) Applicant: TOTO LTD., Fukuoka (JP)

(72) Inventors: Ryohei Yaita, Kitakyushu (JP); Rie Onodera, Kitakyushu (JP); Hiromi Akahira, Kitakyushu (JP); Yasuyuki Enomoto, Kitakyushu (JP); Naoyuki Onodera, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 14/671,317

(22) Filed: Mar. 27, 2015

(65) Prior Publication Data

US 2015/0273498 A1 Oct. 1, 2015

(30) Foreign Application Priority Data

Mar. 31, 2014 (JP) ..... 2014-072961
Nov. 21, 2014 (JP) ..... 2014-236273

(51) Int. Cl.

| | |
|---|---|
| ***E03C 1/08*** | (2006.01) |
| ***B05B 7/04*** | (2006.01) |
| ***B01F 3/04*** | (2006.01) |
| ***E03C 1/04*** | (2006.01) |
| ***E03C 1/084*** | (2006.01) |
| ***E03C 1/10*** | (2006.01) |
| *B05B 1/16* | (2006.01) |

(52) U.S. Cl.

CPC ..... *B05B 7/0416* (2013.01); *B01F 3/04007* (2013.01); *B05B 7/0425* (2013.01); *B05B 7/0433* (2013.01); *B05B 7/0458* (2013.01); *E03C 1/0405* (2013.01); *E03C 1/084* (2013.01); *E03C 1/102* (2013.01); *B05B 1/1654* (2013.01); *B05B 1/1672* (2013.01)

(58) Field of Classification Search

CPC ..... B05B 7/0416; B05B 1/18; E03C 1/102; E03C 1/0405; E03C 1/084; B01F 3/04007
USPC ..... 239/428.5, 428, 397, 575, 588, 590.3, 239/600, 410
See application file for complete search history.

(56) References Cited

U.S. PATENT DOCUMENTS

| | | | | |
|---|---|---|---|---|
| 3,261,555 A * | 7/1966 | Hjulian | E03C 1/084 | 239/427 |
| 3,286,935 A * | 11/1966 | Corlett | E03C 1/084 | 239/428.5 |
| 3,334,818 A * | 8/1967 | Moen | E03C 1/084 | 239/428.5 |
| 4,346,844 A * | 8/1982 | Harmony | B05B 1/1636 | 239/381 |
| 7,017,837 B2 * | 3/2006 | Taketomi | E03C 1/084 | 239/428.5 |

FOREIGN PATENT DOCUMENTS

| | | |
|---|---|---|
| EP | 0429068 A1 | 5/1991 |
| JP | 2010-167086 A | 8/2010 |

* cited by examiner

*Primary Examiner* — Len Tran
*Assistant Examiner* — Joel Zhou
(74) *Attorney, Agent, or Firm* — Studebaker & Brackett PC

(57) ABSTRACT

A water spouting device has a shower flow passage. A guide wall is formed in the shower flow passage. The guide wall turns only a part of a water stream flowing in from an inflow port into a guiding water stream directed to the outside.

12 Claims, 4 Drawing Sheets

W
11
24a
Wa
Wb
Wc
24b
24c
20
24
22

WATER SPOUTING DEVICE

BACKGROUND OF THE INVENTION

1. Field of the Invention

The present invention relates to a water spouting device which generates and spouts air bubble-entrained water by plunging water through an air-liquid interface between air and temporarily stored water.

2. Description of the Related Art

There is a water spouting device hitherto proposed which spouts air bubble-entrained water by entraining air bubbles into water to be spouted (e.g., Japanese Patent Laid-Open No. 2010-167086).

For example, the water spouting device described in the above disclosure can switch between shower water spouting of spouting water in the form of a shower and straight stream water spouting of spouting a single unified water stream. This water spouting device realizes water saving by spouting air bubble-entrained water from both spouts so as to spout large water droplets even at a low water volume while maintaining the flow velocity.

The water spouting device disclosed in Japanese Patent Laid-Open No. 2010-167086 is provided with inflow ports (jet holes), through which water flows in from a water supply source, and turns air introduced through an air intake passage into foam and entrains the air into a water stream flowing in from these inflow ports. More specifically, a negative pressure is generated in an internal space as the water from the inflow ports is jetted, and the air introduced through the air intake passage due to the negative pressure is caught in the water stream flowing in from the inflow ports and turned into fine foam before being entrained into the water. This water spouting device switches by a switching mechanism so that the air bubble-entrained water with foamy air entrained in it is spouted from shower spouts as a water stream in the form of a shower or from a straight stream spout as a single unified water stream. In such a water spouting device, the shower spouts are disposed on the outer peripheral side and the straight stream spout is disposed in a central part on the inside relative to the shower spouts, and an air intake port is provided alongside the shower spouts, separately from the shower spouts and the straight stream spout.

In the conventional technology described in the above disclosure, in the case of shower water spouting, water jetted from the plurality of internal jet holes crashes against the upper end of a separation wall surface and is separated into two water streams, and the water streams are spouted as shower spouting water through two shower spouting water flow passages. As the water is jetted from the internal jet holes, a negative pressure is generated in a space between an internal jet holes forming member (member in which the internal jet holes are formed) and a branch part forming member, and outside air is introduced through the air intake passage due to this negative pressure. The introduced outside air is caught in a water stream, which is formed of the water jetted from the internal jet holes and crashing against the upper end of the separation wall surface, and turned into fine foam and entrained into the water.

While adoption of such a configuration allows air bubble-entrained water to be spouted from the shower spouts formed around the straight stream spout, the number of shower spouts that can correspond to one internal jet hole is only two, and increasing this number may lead to uneven spouting of air bubble-entrained water.

In view of this, one can conceive of applying the mechanism of spouting air bubble-entrained water from the straight stream spout so as to omit the separation wall surface and dispose as many shower spouts as possible for one internal jet hole. One possible example of the specific configuration is a water spouting device including: a rotary member which has a straight stream spout, a shower spout disposed on the outer peripheral side of the straight stream spout, and an inflow port which is disposed on the circumference and through which water flows in from a water supply source, and which rotates around the center of the circumference as the rotational center; a straight stream flow passage extending from the inflow port to the straight stream spout; and a shower flow passage extending from the inflow port to the shower spout. When the water spouting device is used as a water faucet of a lavatory, for example, it is required to be compact in the radial direction as well as in the height direction. In order to meet the demand for compactness in the radial direction, it is preferable that the water spouting device is configured such that the inflow port is shared between straight stream water spouting and shower water spouting, and that rotating the rotary member causes water supplied from the inflow port to flow through either the straight stream flow passage or the shower flow passage.

If the separation wall surface as described in the above disclosure is omitted, it is necessary to sufficiently secure the distance from the inflow ports to the shower spouts so that the air bubble-entrained water formed in the shower flow passage spreads to each one of the shower spouts. However, given the demand for compactness in the height direction as described above, it is not always possible to sufficiently secure that distance. In order to spout the formed air bubble-entrained water from each one of the many shower spouts while reducing the distance from the inflow ports to the shower spouts, it is desirable to provide the inflow ports at positions above a region, where the shower spouts are formed, so as to achieve a balance. In one preferable example, the inflow ports are provided near the center of the region where the shower spouts are formed.

However, if the inflow ports are disposed at ideal positions (near the center in the radial direction of the region where the shower spouts are formed) relative to the shower spouts, the inflow ports are inevitably located at positions away from the straight stream spout. If the inflow ports are thus disposed on the outer peripheral side of the device, the distance from the inflow ports to the straight stream spout, which is provided at the center, becomes longer. This in turn causes the water flowing from the inflow ports to the straight stream spout to decrease in flow velocity before plunging through the air-liquid interface above the straight stream spout, which may result in a decrease in amount of air bubbles entrained into straight stream spouting water. It is therefore preferable to dispose the inflow ports at positions off-center on the straight stream spout side, taking into account a decrease in amount of air bubbles entrained into straight stream spouting water, while forming the inflow ports relatively on the shower spout side.

If the openings of the inflow ports are thus not provided directly above near the center of the region where the shower spouts are formed but disposed at positions on one side eccentric to the center in the radial direction of the shower spout, a difference occurs in the flow velocity of water streams depending on the position of the shower spout. More specifically, the flow velocity of a water stream spouted from a shower spout on one side is higher, while the flow velocity of a water stream spouted from a shower spout on the other side is lower. Moreover, when a difference in flow velocity occurs between shower spouting water on one side and that on the other side, a slower water stream is attached to a faster water stream and the water spouted from the shower spouts becomes a single water stream, so that no water stream in the form of a shower is formed.

The present invention has been devised in view of these problems, and an object of the present invention is to provide a water spouting device which can switch between shower water spouting and straight stream water spouting and can spout air bubble-entrained water in both water spouting states, the water spouting device capable of entraining a large amount of air bubbles in both water spouting states of shower water spouting and straight stream water spouting, as well as of spouting shower water evenly at a high flow velocity.

SUMMARY OF THE INVENTION

In order to solve the above-described problems, the present invention provides a water spouting device which generates and spouts air bubble-entrained water by plunging water through an air-liquid interface between air and temporarily stored water, the water spouting device including:

a first member which has an inflow port through which water flows in from a water supply source and which jets the water toward a downstream side; and a second member which has:

a straight stream spout which spouts air bubble-entrained water as a single unified water stream;

a shower spout which spouts air bubble-entrained water in the form of a shower;

a straight stream flow passage extending from the inflow port side to the straight stream spout; and a shower flow passage extending from the inflow port side to the shower spout, wherein the straight stream spout and the shower spout are disposed in coaxial circles, changing the relative positional relation between the first member and the second member by rotating any one of the first member and the second member can switch between a first state, in which water flows through the straight stream flow passage and air is entrained into this water, and a second state, in which water flows through the shower flow passage and air is entrained into this water, in the second state, the inflow port is disposed at a position on one end side, where the straight stream spout is disposed, eccentric to the center in the radial direction of the shower spout, and a dispersed water stream forming part is formed in the shower flow passage, the dispersed water stream forming part turning a part of a water stream flowing in from the inflow port into a guiding water stream, which flows toward the other end side in the radial direction of the shower spout, by causing it to crash against a guide wall, while turning the rest of the water stream into a directly advancing water stream, which flows toward the one end side in the radial direction of the shower spout, without causing it to crash against the guide wall, and merging the guiding water stream and the directly advancing water stream to form a dispersed water stream.

According to the present invention, since the inflow port is disposed at a position on one side, where the straight stream spout is disposed, eccentric to the center in the radial direction of the shower spout, and since the dispersed water stream forming part is formed in the shower flow passage, it is possible to form the guiding water stream by directing a water stream flowing in from the inflow port toward the other side. Even when the inflow port is disposed at a position on one side, where the straight stream spout is disposed, eccentric to the center in the radial direction of the shower spout, it is possible to supply air bubble-entrained water toward the shower spout formed on the other side. Since the dispersed water stream forming part directs only a part of the water stream flowing in from the inflow port toward the other side, it is possible to reduce unevenness in flow velocity of water streams heading to the shower spout and to spout the water evenly.

In the water spouting device according to the present invention, it is also preferable that the shower spout is formed at a position other than a region defined by projecting the inflow port in a jetting direction.

In the water spouting device according to the present invention, it is also preferable that, an air introduction part for introducing air, a water storage part for storing air bubble-entrained water, and a backflow prevention part, which is provided between the air introduction part and the water storage part and which has a smaller flow passage cross-sectional area than the water storage part so as to prevent backflow of air bubble-entrained water from the water storage part to the air introduction part side, are formed in the shower flow passage, and that the dispersed water stream forming part is formed such that a part of a region defined by projecting an outlet portion of the backflow prevention part toward the downstream side interferes with the guide wall, while the rest of the region interferes with the one end side in the radial direction of the shower spout without interfering with the guide wall.

In the water spouting device according to the present invention, it is also preferable that the dispersed water stream forming part is formed such that a part of a region defined by projecting an outlet portion of the inflow port toward the downstream side interferes with the guide wall, while the rest of the region interferes with the one end side in the radial direction of the shower spout without interfering with the guide wall.

In the water spouting device according to the present invention, it is also preferable that the dispersed water stream forming part is formed such that a part of a region, which is defined by projecting an outlet portion of the inflow port toward the downstream side and which is defined by a water stream diffusing at a spreading angle of 5 degrees after plunging through an air-liquid interface being an interface between air and air bubble-entrained water stored inside the shower flow passage, interferes with the guide wall, while the rest of the region interferes with the one end side in the radial direction of the shower spout without interfering with the guide wall.

In the water spouting device according to the present invention, it is also preferable that the dispersed water stream forming part is formed such that the flow rate of the guiding water stream becomes higher than the flow rate of the directly advancing water stream.

In the water spouting device according to the present invention, it is also preferable that the dispersed water stream forming part is formed such that a part of the guiding water stream is not merged with the directly advancing water stream.

DETAILED DESCRIPTION OF THE PREFERRED EMBODIMENT

Figure 1:
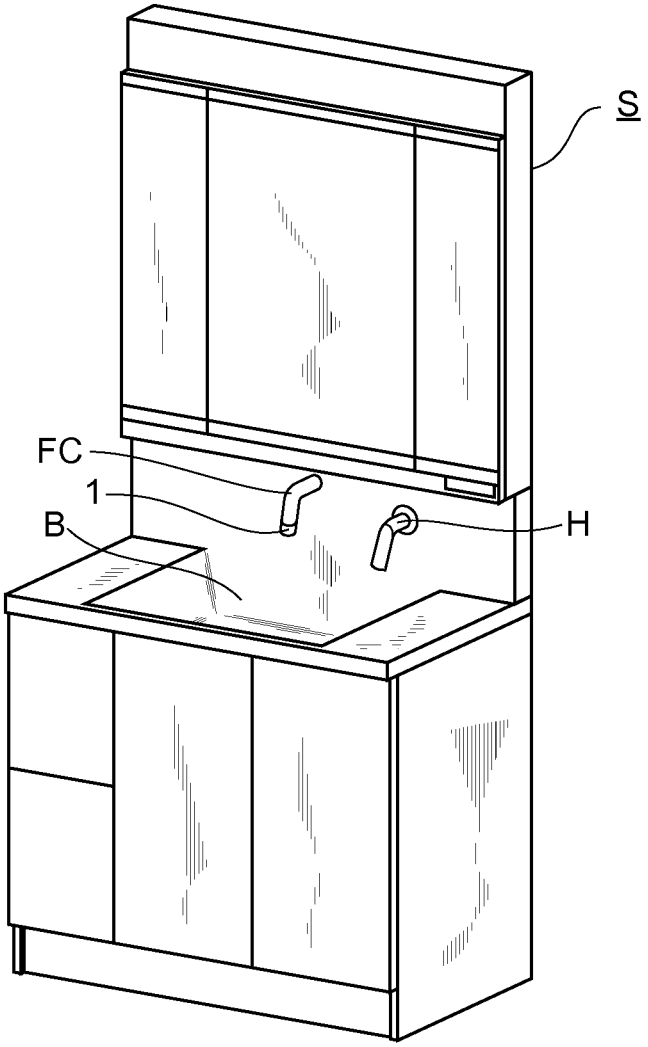
FIG. 1 is a perspective view showing a water faucet unit on which a spout cap according to an embodiment of the present invention is mounted.

In the following, an embodiment of the present invention will be described with reference to the accompanying drawings. To make the description easy to understand, the same components in the drawings will be given the same reference signs as far as possible and a repeated description thereof will be omitted.

The outline of a spout cap (water spouting device) 1, which is one embodiment of the present invention, will be described with reference to FIG. 1 to FIG. 3. FIG. 1 is a perspective view showing an example where the spout cap 1 is used for a washstand S as a component of a water faucet device FC. FIGS. 2A to 2C are cross-sectional views of the spout cap 1. FIGS. 3A and 3B are schematic views showing the relation between inflow ports and flow passages for shower spouting water and straight stream spouting water of the spout cap 1.

The spout cap 1 is a component used for a spout portion of the water faucet device FC. As one example, the water faucet device FC is mounted on a washbasin of the washstand S as shown in FIG. 1. The water faucet device FC has an elongated cylindrical shape formed of stainless steel etc. The water faucet device FC spouts water toward a bowl section B. The bowl section B stores water spouted from the water faucet device FC or receives this water. The water faucet device FC is connected with a water pipe (not shown). The water pipe is mounted in the periphery of the bowl section B and serves as a water supply source of the water faucet device FC.

As shown in FIG. 1, the spout cap 1 is mounted at a leading end part of the water faucet device FC. The spout cap 1 covers the leading end part of the water faucet device FC. The spout cap 1 spouts water supplied from the water pipe as shower spouting water or straight stream spouting water. The shower spouting water is composed of a plurality of thin water streams. The straight stream spouting water is composed of a single unified water stream. Both the shower spouting water and the straight stream spouting water are air bubble-entrained water which is formed as air is suctioned from the outside and the air turned into foam is entrained into the water. The spout cap 1 is configured such that rotating the leading end part thereof can switch the water spouting state of the spout cap 1 between shower water spouting and straight stream water spouting.

Next, the specific configuration and the outline of the operation of the spout cap 1 will be described with reference to FIG. 2 and FIG. 3. The spout cap 1 has a circular cylindrical shape as a whole. The spout cap 1 is composed of a first cylinder part 10 (rotary member) and a second cylinder part 20. In the spout cap 1, rotating the second cylinder part 20 relative to the first cylinder part 10 can switch between shower water spouting and straight stream water spouting.

Figure 2A:
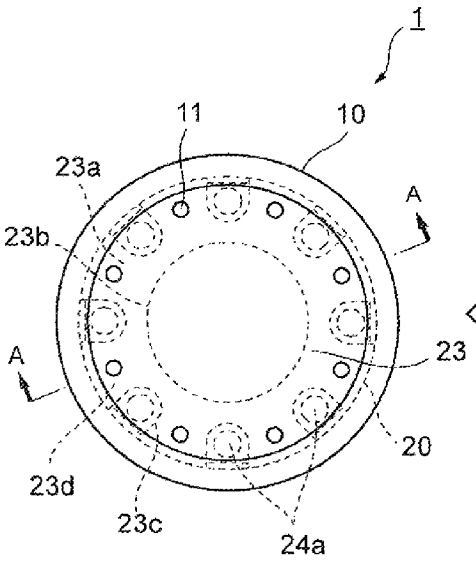
FIGS. 2A to 2C are schematic views showing the relation between inflow ports and shower and straight stream flow passages of the spout cap shown in FIG. 1.

FIG. 2A shows a first state (hereinafter referred to as a "straight stream state") in which water flows through the straight stream flow passage and air from the shower flow passage is entrained into this water. FIG. 2C shows a second state (hereinafter referred to as a "shower state") in which water flows through the shower flow passage and air from the straight stream flow passage is entrained into this water. The state shown in FIG. 2B is a state in the middle of switching between the state shown in FIG. 2A and the state shown in FIG. 2C.

Figure 2B:
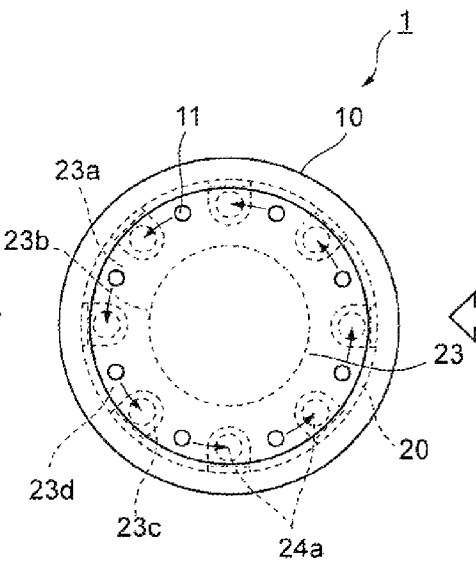
Figure 2C:
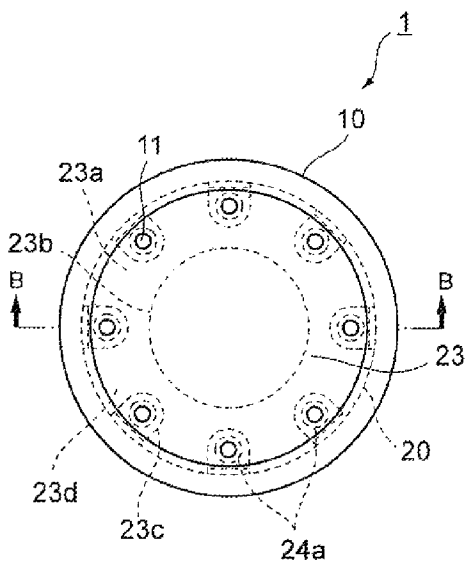
Figure 3B:
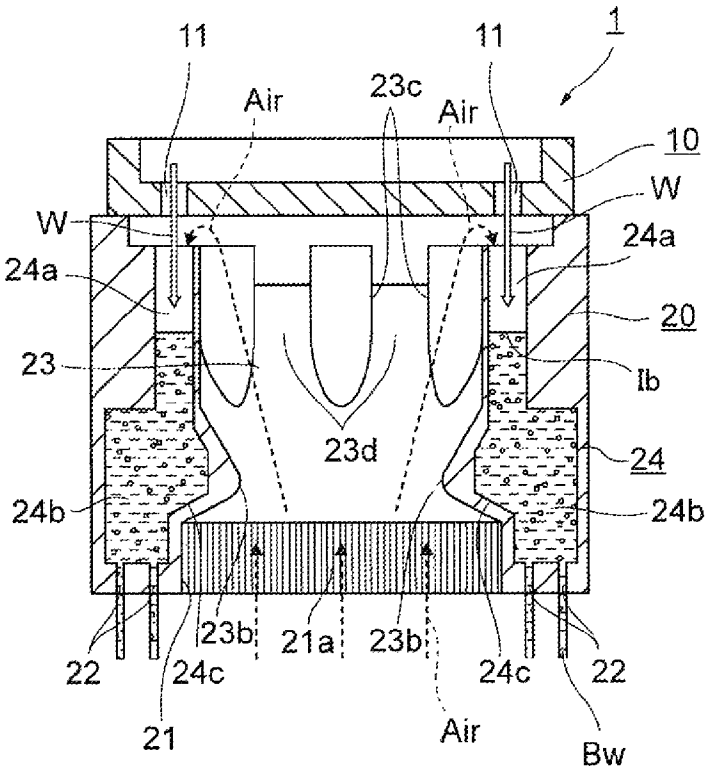
FIGS. 3A and 3B are schematic views showing the outline of the operation of the spout cap shown in FIG. 1.
Figure 3A:
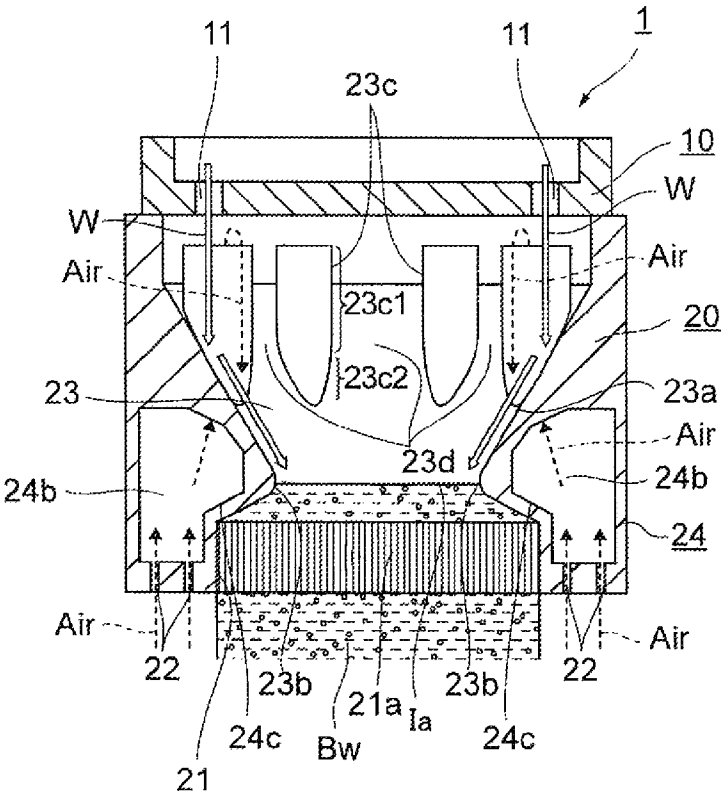

FIGS. 2A to 2C are views of the first cylinder part 10 from the bottom side of the first cylinder part 10 (from the second cylinder part 20 side). The part indicated by the broken line is the second cylinder part 20, and it is indicated by projecting the position of the second cylinder part 20 on the first cylinder part 10. For the convenience of description, FIG. 2 shows how the first cylinder part 10 is rotated while the second cylinder part 20 is not moved; however, it is more common to rotate the second cylinder part 20 relative to the first cylinder part 10. The exterior of the spout cap 1 is covered with the cylindrical water faucet device FC as described above, and FIG. 2 and FIG. 3 show the internal components with the exterior removed.

As shown in FIG. 2, the first cylinder part 10 is provided with a plurality of inflow ports 11 (here, with eight inflow ports at regular intervals) on the circumference. Water from the water pipe being a supply source is supplied to the inflow ports 11. The inflow ports 11 are provided along the outer periphery of the first cylinder part 10. In the shower state shown in FIG. 2C, the inflow ports 11 are disposed at positions communicating with a shower flow passage 24 to be described later.

The second cylinder part 20 is provided with a straight stream spout 21 and a shower spout 22. The straight stream spout 21 spouts air bubble-entrained water as a single unified water stream. The shower spout 22 spouts air bubble-entrained water in the form of a shower. The shower spout 22 is disposed on the outer periphery of the straight stream spout 21. The second cylinder part 20 is provided with the straight stream flow passage 23 and the shower flow passage 24. The straight stream flow passage 23 communicates between the inflow ports 11 and the straight stream spout 21. The shower flow passage 24 communicates between the inflow ports 11 and the shower spout 22.

The straight stream spout 21 is formed in a central portion of the second cylinder part 20. A stream straightening mesh 21*a* is disposed in the straight stream spout 21. The stream straightening mesh 21*a* has a lattice-like shape, and has a large number of fine pores. Disturbance of water to be spouted from the straight stream spout 21 is suppressed as the water flows through the pores of the stream straightening mesh 21*a*. As a result, the flow of the water spouted from the straight stream spout 21 is calmed down, and water scattering on the bowl section B etc. is suppressed. In addition, the stream straightening mesh 21*a* temporarily retains water to be spouted in the straight stream flow passage 23 to be described later by giving a flow passage resistance to the water flowing into the straight stream spout 21. An air-liquid interface to be described later is formed between this retained water and air.

The shower spout 22 is formed at the leading end of the shower flow passage 24 to be described later. The shower spout 22 is composed of a plurality of small holes, and spouts water flowing through the shower flow passage 24 as shower spouting water. The shower spout 22 also gives a flow passage resistance to the water flowing through the shower flow passage 24 and thereby imparts flow velocity to the water to be spouted. In addition, the shower spout 22 temporarily retains the water to be spouted. An air-liquid interface to be described later is formed between this retained water and air.

The straight stream flow passage 23 is a flow passage which guides water from the inflow ports 11 toward the straight stream spout 21. The straight stream flow passage 23 is provided with a flow passage wall 23*a* which is tapered toward the straight stream spout 21. It is an essential requirement that the flow passage wall 23*a* is tapered toward the straight stream spout 21. The flow passage wall 23*a* of this embodiment is provided with a constricted portion 23*b* having the minimum diameter on the upstream side of the stream straightening mesh 21*a*. The diameter of the flow passage wall 23*a* on the downstream side becomes larger from the constricted portion 23*b* toward the straight stream spout 21.

In the straight stream flow passage 23, a guide part 23*c* is provided so as to protrude from the flow passage wall 23*a*. The guide part 23*c* divides the straight stream flow passage 23 into a plurality of divided flow passages 23*d* on the circumference. The guide part 23*c* is composed of a plurality of (here, eight) circular cylindrical members disposed on the circumference of the straight stream flow passage 23. The guide parts 23*c* are disposed so as to extend in the gravitational direction relative to the tapered flow passage wall 23*a*. Accordingly, the guide parts 23*c* as a whole are formed so as to be thinner on the straight stream spout 21 side than on the inflow port 11 side. In particular, the guide part 23*c* of this embodiment has a first region 23*c*1, which is formed at a constant width from the inflow port 11 side toward the straight stream spout 21, and a second region 23*c*2, which becomes gradually thinner on the downstream side of the first region 23*c*1.

The upstream side of the divided flow passages 23*d* divided by the guide part 23*c* are formed at a constant width along the first region 23*c*1 and the second region 23*c*2 described above. The downstream side of the divided flow passages 23*d* expands gradually. The divided flow passages 23*d* merge into one flow passage on the upstream side of the constricted portion 23*b*.

Thus, the divided flow passages 23*d* divided by the guide part 23*c* prevents the flow of water from the inflow port 11 toward the straight stream spout 21 from meandering along the flow passage wall 23*a*, and regulates the flow of water so that water streams flowing through the divided flow passages 23*d* do not merge with one another. Ideally, the guide part 23*c* regulates the flow of water so that the water advances linearly in the direction of the conical center of the tapered flow passage wall 23*a*. In other words, the guide part 23*c* ideally regulates the flow of water so that the water flows in the shortest distance toward the central axis of the air-liquid interface to be described later.

The shower flow passage 24 is a flow passage which guides the water from the inflow port 11, which is formed on the inner peripheral side, toward the shower spout 22. More specifically, the shower flow passage 24 is disposed in the second cylinder part 20 on the outside relative to the straight stream flow passage 23 across the flow passage wall 23*a*. A plurality of backflow prevention parts 24*a* is disposed on the circumference on the upstream side of the shower flow passage 24. The backflow prevention part 24*a* is formed in a cylindrical shape so as to prevent backflow of the water from the shower spout 22 side. A water storage part 24*b* is provided on the downstream side of the shower flow passage 24. The water storage part 24*b* penetrates a lower part of the second cylinder part 20 in a doughnut shape. The water storage part 24*b* temporarily stores water. The flow passage cross-sectional area of the backflow prevention part 24*a* is smaller than the flow passage cross-sectional area of the water storage part 24*b*.

The plurality of backflow prevention parts 24*a* (here, eight backflow prevention parts at regular intervals) is provided on the outer peripheral side of the second cylinder part 20 in alignment with the positions of the inflow ports 11 on the outer periphery. The backflow prevention part 24*a* forms the shower flow passage 24. In the backflow prevention part 24*a*, water from the inflow port 11 flows directly downward in the gravitational direction. The wall surface of this backflow prevention part 24*a* protrudes into the straight stream flow passage 23 and thereby functions as the guide part 23*c* inside the straight stream flow passage 23.

On the other hand, the water storage part 24*b* protrudes toward the inside of the second cylinder part 20. This protruding portion of the water storage part 24*b* is disposed at a position corresponding to the tapered portion of the flow passage wall 23*a* of the straight stream flow passage 23. The volume of the water storage part 24*b* is increased due to this protruding portion of the water storage part 24*b*. The protruding portion of the water storage part 24*b* protrudes to the straight stream flow passage 23 side. The constricted portion 23*b* is formed in the straight stream flow passage 23 due to this protruding portion of the water storage part 24*b*. The water storage part 24*b* is another component of the shower flow passage 24.

The water storage part 24*b* further has an annular guide wall 24*c* (dispersed water stream forming part) on the downstream side of the protruding portion. The guide wall 24*c* is provided in the portion of the flow passage wall 23*a* expanding toward the straight stream spout 21. This guide wall 24*c* is disposed so as to at least partially overlap the cross-section of the backflow prevention part 24*a*. Accordingly, when the water spouting state of the spout cap 1 is switched from the straight stream state to the shower state through rotation of the second cylinder part 20 of the spout cap 1, the water flowing in from the backflow prevention part 24*a* of the shower flow passage 24 first flows directly downward and crashes against the guide wall 24*c*. In this embodiment, it is desirable that the entire water flowing from the backflow prevention part 24*a* crashes against the guide wall 24*c*. In this embodiment, it is preferable that the guide wall 24*c* and the shower spout 22 are fixedly formed, that is, for example, the guide wall 24*c* is formed of the same member as the shower spout 22 so that the guide wall 24*c* is formed as a part of the second cylinder part 20.

The outline of the operation of the spout cap 1 configured as described above will be described using FIG. 3. FIG. 3A is a view showing, as the straight stream state being a first state, a water spouting state in which water W flows through the straight stream flow passage 23 and air from the shower flow passage 24 is entrained into the water W. FIG. 3B is a view showing, as the shower state being a second state, a water spouting state in which water W flows through the shower flow passage 24 and air from the straight stream flow passage 23 is entrained into the water W.

As shown in FIG. 3A, in the straight stream state, when the water W is supplied from the plurality of inflow ports 11 formed on the outer periphery of the first cylinder part 10, the water W flows down in the gravitational direction into the straight stream flow passage 23 and crashes against the flow passage wall 23*a*. The water W is guided to the straight stream spout 21 side while splashing on the flow passage wall 23*a* or flowing down along the flow passage wall 23*a*.

The relation between the inflow ports 11 and the second cylinder part 20 in this straight stream state is as shown in FIG. 2A.

During this process, the shower spout 22 functions as an air introduction port, while the shower flow passage 24 functions as an air flow passage. That is, as shown in FIG. 3A, as the water is jetted out from the inflow port 11 toward the straight stream flow passage 23, a negative pressure is generated in the shower flow passage 24, and the air flows in from the shower spout 22 through the shower flow passage 24 toward the straight stream flow passage 23. The air flows from the water storage part 24*b* through the backflow prevention part 24*a* into the straight stream flow passage 23, and is caught in the flow of the water W and turned into foam.

As water is temporarily retained on the stream straightening mesh 21*a*, an air-liquid interface Ia is formed in the straight stream spout 21. As the water W plunges through this air-liquid interface Ia and the air turned into foam is entrained into the water W, air bubble-entrained water Bw is generated. The air bubble-entrained water Bw passes through the stream straightening mesh 21*a* and is sequentially spouted from the straight stream spout 21.

On the other hand, as shown in FIG. 3B, in the shower state, when the water W is supplied from the plurality of inflow ports 11 formed on the outer periphery of the first cylinder part 10, the water W flows down in the gravitational direction into the backflow prevention part 24*a* of the shower flow passage 24, and is guided directly to the water storage part 24*b* located directly under the backflow prevention part 24*a*. The relation between the inflow ports 11 and the second cylinder part 20 in this shower state is as shown in FIG. 2C.

During this process, the straight stream spout 21 functions as an air introduction port, while the straight stream flow passage 23 functions as an air flow passage. That is, as shown in FIG. 3A, as the water is jetted out from the inflow port 11 toward the straight stream flow passage 23, a negative pressure is generated on the straight stream flow passage 23 side and the air flows in from the straight stream spout 21 through the straight stream flow passage 23 toward the straight stream flow passage 23. The air passes through the straight stream flow passage 23 from the stream straightening mesh 21*a* and flows into the backflow prevention part 24*a* of the shower flow passage 24, and is caught in the flow of the water W and turned into foam.

As the water is temporarily retained in the water storage part 24*b* due to the flow passage resistance of the shower spout 22, an air-liquid interface Ib is formed in the shower flow passage 24. As the water W plunges through the air-liquid interface Ib and the air turned into foam is entrained into this water W, air bubble-entrained water Bw is generated. The air bubble-entrained water Bw is spouted to the outside through the shower spout 22.

In the spout cap 1 of this embodiment, the straight stream state being the first state and the shower state being the second state as described above are realized by rotating the second cylinder part 20 relative to the first cylinder part 10 so as to shift the state shown in FIG. 2A to the state shown in FIG. 2C.

Figures 4A, 4B, 4C, 4D:
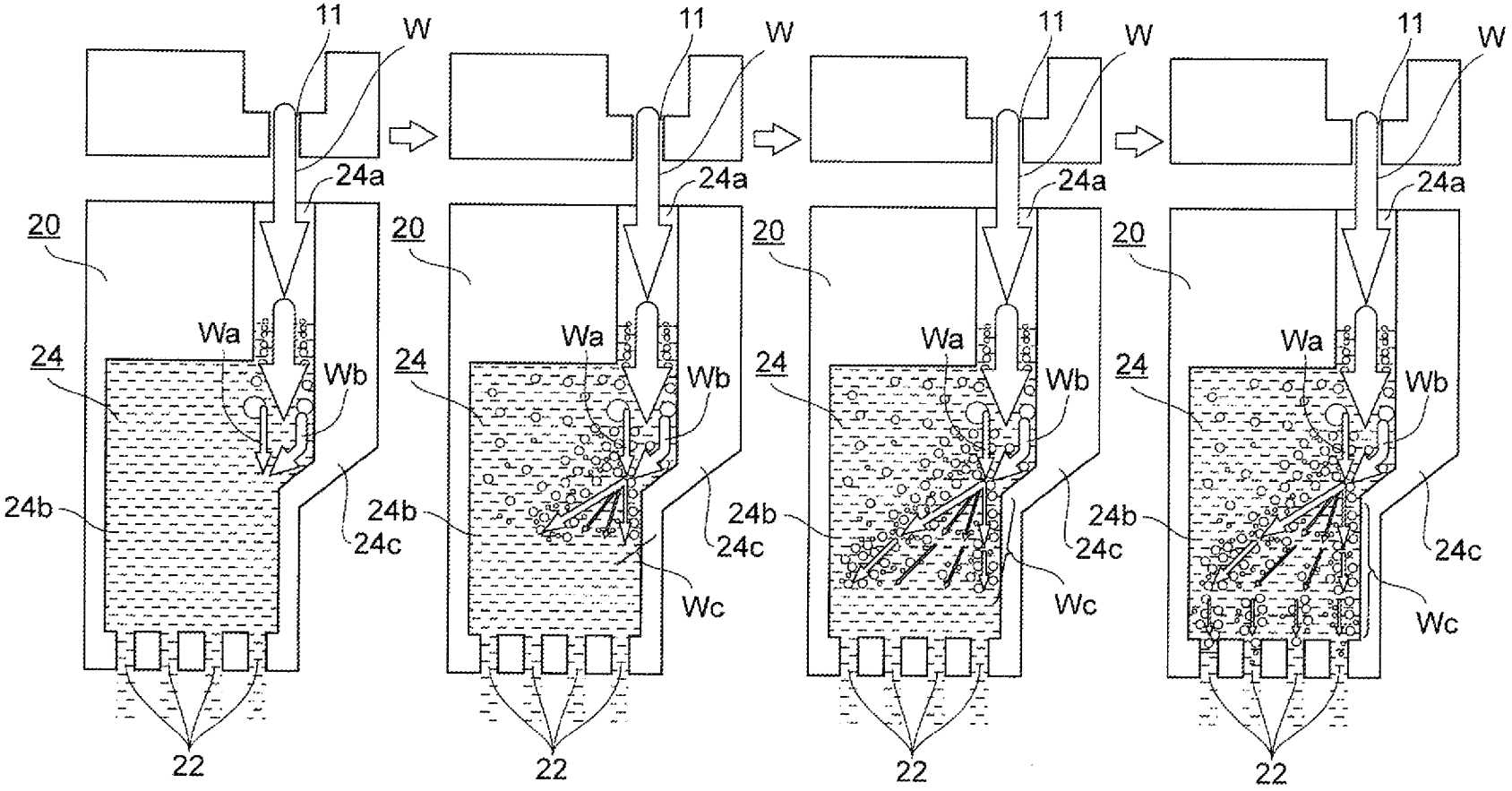
FIGS. 4A to 4D are cross-sectional views showing the configuration of the shower flow passage of the spout cap shown in FIG. 1.

Next, the water flow inside the shower flow passage 24 will be described with reference to FIG. 4. FIGS. 4A to 4D schematically show the cross-section of the shower flow passage 24. FIGS. 4A, 4B, 4C, and 4D show states of the water W flowing downward from the inflow port 11 through the backflow prevention part 24*a* in a time sequence after the water W is jetted. Once the jetting of the water W reaches a steady state, the state shown in FIG. 4D continues.

When plunging through the air-liquid interface Ib, the water W jetted from the inflow port 11 forms a water stream Wa on the outside and a water stream Wb on the inside. The inflow port 11 and the guide wall 24*c* of this embodiment are in such a positional relation that the water stream Wa does not crash against the guide wall 24*c* and the water stream Wb crashes against the guide wall 24*c*. Here, the water W flowing in from the inflow port 11 diffuses (when a water stream at a flow velocity equal to or higher than 50% of the flow velocity before the water plunges through the air-liquid interface is regarded as a diffusional stream) at the spreading angle of 5 degrees after plunging through the air-liquid interface Ib at a flow velocity within the range of 3.7-14.7 m/s (the range of flow velocities at which air can be entrained at the flow rate of 2 L/min which is used in a common water spouting device). It is therefore an essential requirement that the guide wall 24*c* (dispersed water stream forming part) is disposed relative to the inflow port 11 such that only a part of the water stream, which is formed by a region defined by projecting the inflow port 11 in the jetting direction and the region of the water stream diffusing at the spreading angle of 5 degrees after plunging through the air-liquid interface Ib, crashes against the guide wall 24*c*.

The water stream Wb functions as a guiding water stream, as it is turned in direction toward the inside upon crashing against the guide wall 24*c* and heads to the shower spout 22 at a position farther from the backflow prevention part 24*a*.

Since the water stream Wa is jetted so as not to crash against the guide wall 24*c*, the water stream Wa merges with the water stream Wb, which is a guiding water stream, from the upper side toward the lower side. Therefore, the direct-advance component of the water stream Wb is reduced due to the action of the water stream Wa which functions as a directly advancing water stream, so that the difference in velocity between the water streams is reduced. In addition, as a downward force is added by the action of a water stream We merging from above, the water streams can be dispersed more evenly.

Thus, when the inflow port 11 is formed not directly above the shower spout 22 but is disposed on the straight stream spout 21 side (inside) off-center from the shower spout 22, and even with a compact water spouting device having a short distance from the inflow port 11 to the shower spout 22, it is possible to disperse the water streams evenly to the shower spout 22 and to distribute the flow velocity evenly across the shower spout 22. When the inflow port 11 is disposed eccentrically (off-center) on the straight stream spout 21 side, it is preferable that the central axis in the jetting direction of the inflow port 11 is disposed on the straight stream spout 21 side eccentric (off-center) to the center between the center in the radial direction of the shower spout 22 and the wall surface of the shower flow passage 24.

The flow rate of the water stream Wb which is the guiding water stream is higher than the flow rate of the water stream Wa which is the directly advancing water stream.

In this embodiment, a part of the water stream Wb being the guiding water stream is not merged with the water stream Wa being the directly advancing water stream. Since the water stream Wb is turned in direction upon hitting the planar guide wall 24*c*, the water stream Wb flows while spreading in the direction penetrating the plane of the sheet of FIG. 4. On the other hand, since the water stream Wa advances directly without crashing against any wall, it flows in a narrower stream than the water stream Wb. Thus, since a part of the water stream Wb is guided toward the outside of the shower spout 22 without being influenced by the water stream Wa, the water streams can be dispersed more evenly.

In the foregoing embodiment, the shower spout 22 is disposed on the outside and the straight stream spout 21 is disposed on the inside. However, the configuration of the spout cap 1 according to the present invention shall not be limited to this example. For example, the shower spout 22 may be disposed on the inside and the straight stream spout 21 may be disposed on the outside. Moreover, while in the foregoing embodiment, air is suctioned from the shower spout 22 and the straight stream spout 21, the present invention is not limited to this example. In the spout cap 1 according to the present invention, air may be suctioned from other places.

The embodiment of the present invention has been described with reference to specific examples. However, the present invention is not limited to these specific examples. That is, these specific examples with appropriate design changes added thereto by those skilled in the art are also encompassed in the scope of the present invention as long as such examples have the features of the present invention. For example, the components of the above-described specific examples, and their arrangement, materials, conditions, shapes, etc. are not limited to those illustrated but can be appropriately changed. In addition, the components of the embodiment can be combined as far as technically possible, and these combinations are also encompassed in the scope of the present invention as long as such combinations have the features of the present invention.

What is claimed is:

1. A water spouting device which generates and spouts air bubble-entrained water by plunging water through an air-liquid interface between air and temporarily stored water, the water spouting device comprising: a first member which has an inflow port through which water flows in from a water supply source and which jets the water toward a downstream side; and a second member which has: a straight stream spout which spouts air bubble-entrained water as a single unified water stream; a shower spout which spouts air bubble-entrained water in the form of a shower; a straight stream flow passage extending from the inflow port side to the straight stream spout; and a shower flow passage extending from the inflow port side to the shower spout, wherein the straight stream spout and the shower spout are disposed in coaxial circles, changing the relative positional relation between the first member and the second member by rotating any one of the first member and the second member can switch between a first state, in which water flows through the straight stream flow passage and air is entrained into this water, and a second state, in which water flows through the shower flow passage and air is entrained into this water, the inflow port is eccentrically disposed relative to the center of the shower spout in the radial direction, and a dispersed water stream forming part is formed in the shower flow passage, the dispersed water stream forming part turning a part of a water stream flowing in from the inflow port into a guiding water stream, which flows toward the other end side in the radial direction of the shower spout, by causing it to crash against a guide wall, while turning the rest of the water stream into a directly advancing water stream, which flows toward the one end side in the radial direction of the shower spout, without causing it to crash against the guide wall and an inner wall surface of the shower flow passage, and merging the guiding water stream and the directly advancing water stream to form a dispersed water stream.

2. The water spouting device according to claim 1, wherein the shower spout is formed at a position other than a region defined by projecting the inflow port in a jetting direction.

3. The water spouting device according to claim 1, wherein an air introduction part for introducing air, a water storage part for storing air bubble-entrained water, and a backflow prevention part, which is provided between the air introduction part and the water storage part and which has a smaller flow passage cross-sectional area than the water storage part so as to prevent backflow of air bubble-entrained water from the water storage part to the air introduction part side, are formed in the shower flow passage, and the dispersed water stream forming part is formed such that a part of a region defined by projecting an outlet portion of the backflow prevention part toward the downstream side interferes with the guide wall, while the rest of the region interferes with the one end side in the radial direction of the shower spout without interfering with the guide wall.

4. The water spouting device according to claim 1, wherein the dispersed water stream forming part is formed such that a part of a region defined by projecting an outlet portion of the inflow port toward the downstream side interferes with the guide wall, while the rest of the region interferes with the one end side in the radial direction of the shower spout without interfering with the guide wall.

5. The water spouting device according to claim 1, wherein the dispersed water stream forming part is formed such that a part of a region, which is defined by projecting an outlet portion of the inflow port toward the downstream side and which is defined by a water stream diffusing at a spreading angle of 5 degrees after plunging through an air-liquid interface being an interface between air and air bubble-entrained water stored inside the shower flow passage, interferes with the guide wall, while the rest of the region interferes with the one end side in the radial direction of the shower spout without interfering with the guide wall.

6. The water spouting device according to claim 1, wherein the dispersed water stream forming part is formed such that the flow rate of the guiding water stream becomes higher than the flow rate of the directly advancing water stream.

7. The water spouting device according to claim 1, wherein the dispersed water stream forming part is formed such that a part of the guiding water stream is not merged with the directly advancing water stream.

8. The water spouting device according to claim 2, wherein an air introduction part for introducing air, a water storage part for storing air bubble-entrained water, and a backflow prevention part, which is provided between the air introduction part and the water storage part and which has a smaller flow passage cross-sectional area than the water storage part so as to prevent backflow of air bubble-entrained water from the water storage part to the air introduction part side, are formed in the shower flow passage, and the dispersed water stream forming part is formed such that a part of a region defined by projecting an outlet portion of the backflow prevention part toward the downstream side interferes with the guide wall, while the rest of the region interferes with the one end side in the radial direction of the shower spout without interfering with the guide wall.

9. The water spouting device according to claim 2, wherein the dispersed water stream forming part is formed such that a part of a region defined by projecting an outlet portion of the inflow port toward the downstream side interferes with the guide wall, while the rest of the region interferes with the one end side in the radial direction of the shower spout without interfering with the guide wall.

10. The water spouting device according to claim 2, wherein the dispersed water stream forming part is formed such that a part of a region, which is defined by projecting an outlet portion of the inflow port toward the downstream side and which is defined by a water stream diffusing at a spreading angle of 5 degrees after plunging through an air-liquid interface being an interface between air and air bubble-entrained water stored inside the shower flow passage, interferes with the guide wall, while the rest of the region interferes with the one end side in the radial direction of the shower spout without interfering with the guide wall.

11. The water spouting device according to claim 2, wherein the dispersed water stream forming part is formed such that the flow rate of the guiding water stream becomes higher than the flow rate of the directly advancing water stream.

12. The water spouting device according to claim 2, wherein the dispersed water stream forming part is formed such that a part of the guiding water stream is not merged with the directly advancing water stream.

* * * * *